US006736260B2

(12) United States Patent
Gomes et al.

(10) Patent No.: US 6,736,260 B2
(45) Date of Patent: May 18, 2004

(54) NECK-THROUGH THE TOP CARTON

(75) Inventors: Jean-Manuel Gomes, Marietta, GA (US); Stephen Mark Gould, Stoke Gifford (GB)

(73) Assignee: Graphic Packaging International, Inc., Marietta, GA (US)

( * ) Notice: Subject to any disclaimer, the term of this patent is extended or adjusted under 35 U.S.C. 154(b) by 60 days.

(21) Appl. No.: 10/218,702

(22) Filed: Aug. 14, 2002

(65) Prior Publication Data

US 2004/0031703 A1 Feb. 19, 2004

(51) Int. Cl.[7] ..... B65D 75/00
(52) U.S. Cl. ..... 206/175; 206/193; 206/434
(58) Field of Search ..... 206/140, 141, 206/142, 143, 147, 157, 162, 167, 168, 169, 170, 172, 174, 175, 193, 194, 196, 199, 200, 427, 429, 431, 434; 229/117.12

(56) References Cited

U.S. PATENT DOCUMENTS 2,529,675 A * 11/1950 William ..... 206/169
3,140,036 A * 7/1964 Spery ..... 206/141
3,814,238 A * 6/1974 Wood ..... 206/167
4,171,046 A * 10/1979 Bonczyk ..... 206/193
4,205,748 A * 6/1980 Wilson ..... 206/174
4,243,138 A * 1/1981 Wilson ..... 206/188
4,319,682 A * 3/1982 Wright et al. ..... 206/180
5,167,325 A * 12/1992 Sykora ..... 206/143
5,499,712 A * 3/1996 Harrelson ..... 206/172
5,518,110 A * 5/1996 Harrelson ..... 206/139
6,168,013 B1 * 1/2001 Gomes ..... 206/162
6,341,689 B1 * 1/2002 Jones ..... 206/175
6,571,941 B2 * 6/2003 Holley, Jr. ..... 206/162

* cited by examiner

*Primary Examiner*—Shian Luong

(57) ABSTRACT

The neck-through the top carton blank for forming a carton with a four-ply handle and two-ply top panels with apertures through which the necks of bottles can be extended. The apertures in the top panel have an arcuate extended opening projecting towards the handle panel to minimize damage to the labels of the necks of bottles extending through the apertures. The fold lines for gluing this blank into a car-on are parallel to each other.

13 Claims, 7 Drawing Sheets

NECK-THROUGH THE TOP CARTON

BACKGROUND OF THE INVENTION

1. Field of the Invention

The present invention relates to bottle cartons that have apertures in a top panel for the necks of bottles and provide full protection for glass bottles. These cartons have been constructed so that they have a four-ply handle and two-ply top panels with apertures. In addition, it has a two-ply median panel that is foldably attached to one end of the carton. These cartons have been constructed so that they are easy to fold and glue on an in-line gluer. All of the fold lines for folding various panels and flaps of the carton are parallel to the longitudinal line of the gluer.

2. Background of the Invention

Right-angle gluers for folding and gluing cartons are timed and consequently make it relatively easy to fold and glue cartons. In-line gluers are not so timed, so it is more difficult to fold and glue a carton on an in-line gluer. It would be desirable to develop a neck-through the top carton that easily could be folded and glued on an in-line gluer. It would be necessary to have the various flaps and panels that are folded and glued arranged so that they simply can be flipped over 180° and then glued to the appropriate panel or flap without undesirable bunching of the paperboard.

Glass bottles need protection around all sides of the bottles to minimize breakage. Glass bottles also need a carton with a strong handle to support the heavy weight of the filled bottles. All beverage bottlers like to have labels on the necks of bottles to promote their brand to consumers. There is a tendency for these labels to be damaged during loading or shipment by the apertures into which they extend in neck-through the top cartons. It would be desirable to find the way to minimize this from occurring.

SUMMARY OF THE INVENTION

It is the object of this invention to develop a neck-through the top carton to provide full protection for bottles that can be folded and glued on in-line gluers. It is a further object of this invention to develop a neck-through the top carton that has a handle that is strong enough to support filled glass bottles. It is another object of this invention to develop a neck-through the top carton which has apertures through which the necks of bottles extend which do not damage the labels on the necks of the bottles.

The objects of this invention have been obtained by providing a carton where all the fold lines for folding panels of the carton are parallel to the longitudinal line of the gluer. The neck through the top carton has a four-ply handle and two-ply top panels with apertures through which the necks of the bottles extend. The carton has cell dividers to separate each bottle from adjoining bottles and two-ply partition panels, each panel being foldably attached to one end of the carton. The partition panels, top median panels and a bottom keels face each other and are glued together provide additional support for the carton. In addition, partition panels may have end strips that are glued together.

The apertures in the top panels through which the necks of the bottles extend and have an arcuate extended opening projecting towards the handle panels to prevent damage to any labels on the necks of the bottles. The strength of this carton is enhanced by having two-ply top panels through which the necks of the bottles extend and a four-ply handle panel that is glued together to form an integrated structure.

These and other objects, features, and advantages of the present invention will become more apparent upon reading the following specification in conjunction with the accompanying drawing figures.

DETAILED DESCRIPTION OF THE PREFEERED EMBODIMENTS

Figure 1A:
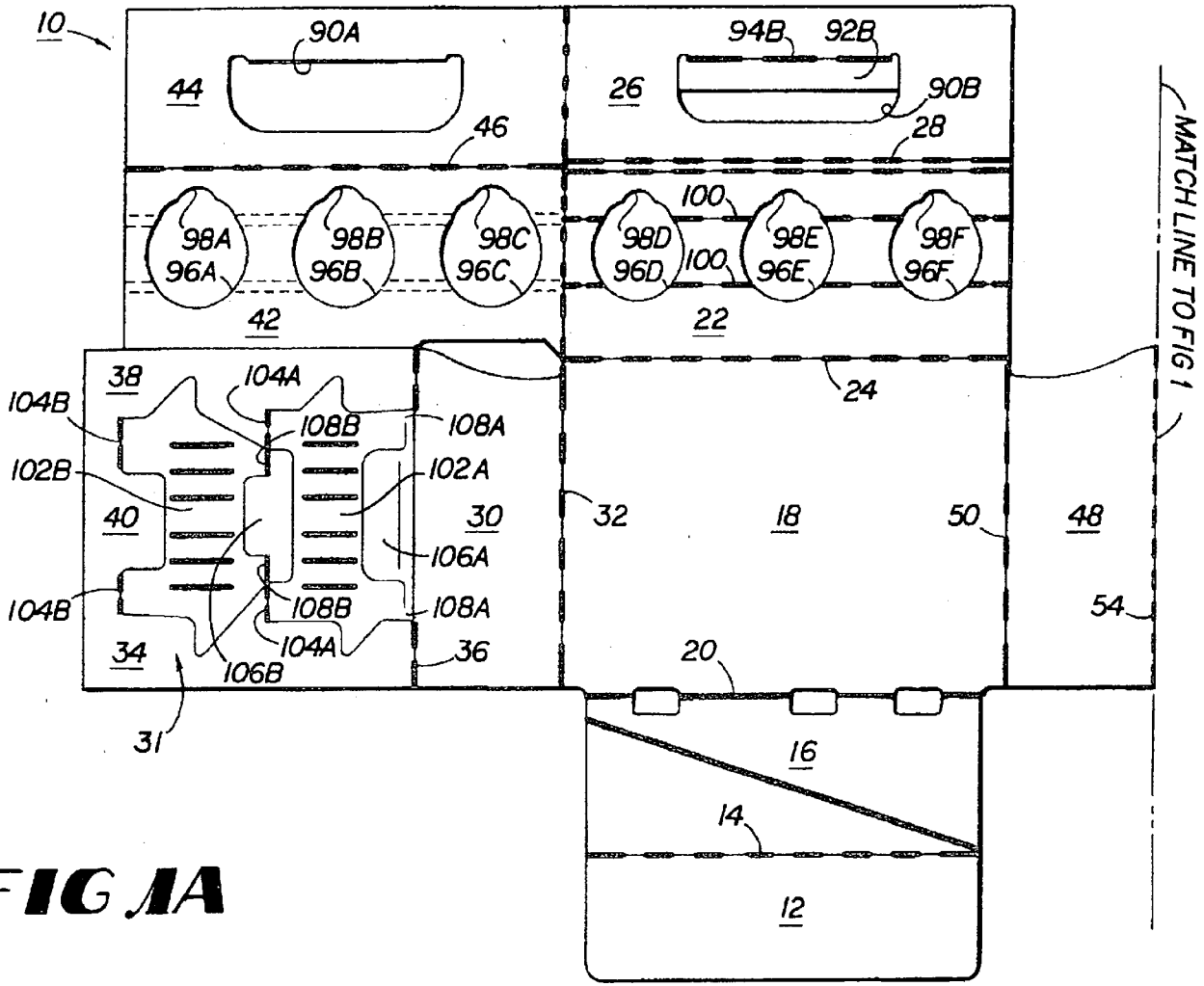
FIGS. 1A and 1B are a plan view connected by match lines of a blank for forming an embodiment of the carton of this invention.
Figure 1B:
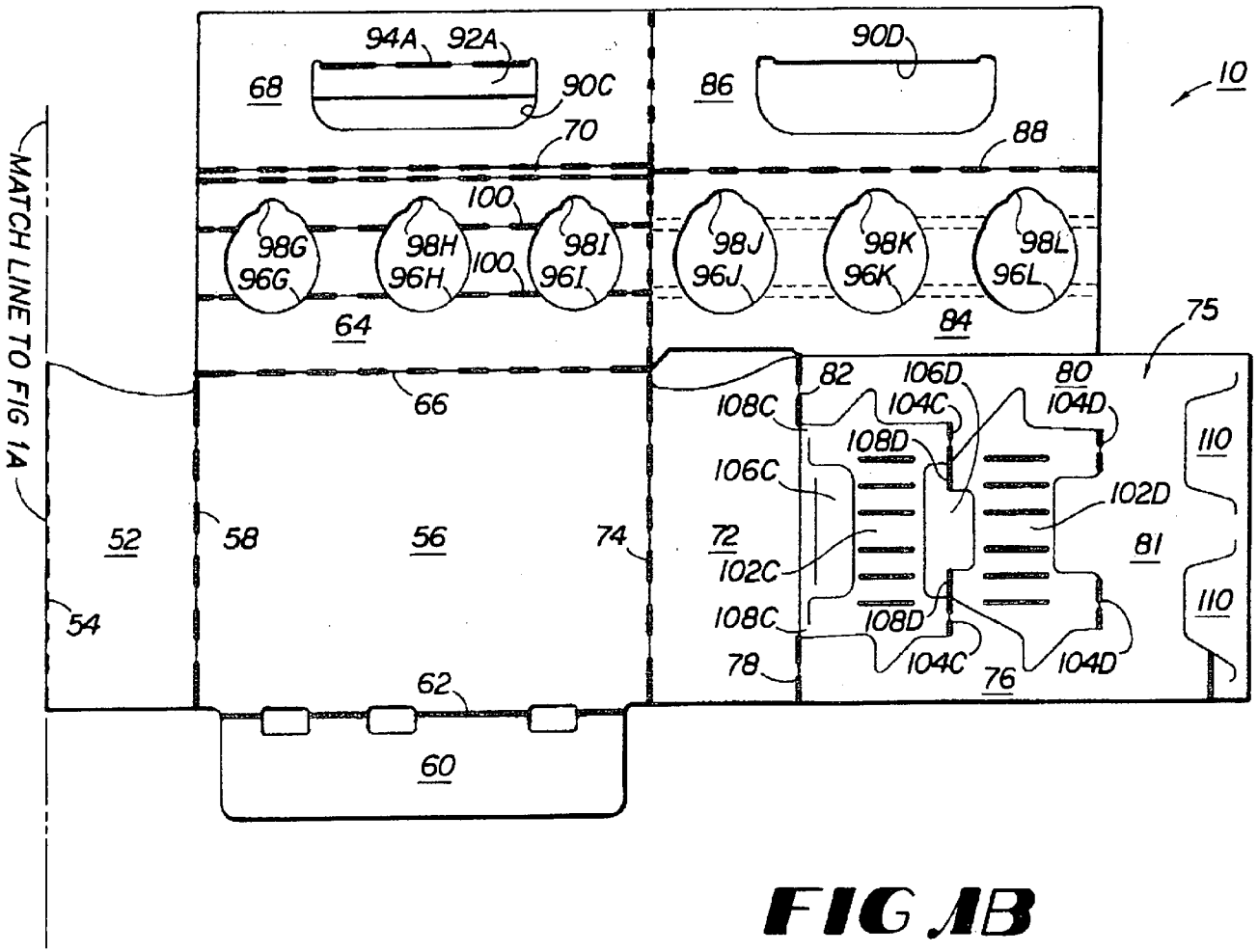

The present invention are neck-through the top cartons that provide full protection for the bottles being carried. The cartons can be formed from a single piece of foldable material, such as a blank cut out of paperboard. The layout of the blank is basically rectangular, which results in economizing the amount of paperboard used. These cartons can be used for carrying from four to twelve bottles. They are especially designed to carry six bottles. Because the cartons are designed to carry glass bottles, they provide full protection for the glass. These cartons are designed for folding and gluing on an in-line gluer.

The composite figures of 1A and 1B form a plan view of the blank panel carton of one embodiment of this invention. The blank is represented by the numeral 10. Bottom flap 12 is attached by fold line 14 to bottom panel 16 and in turn is attached to side panel 18 by fold line 20. Side panel 18 is attached to top panel 22 by fold line 24 and in turn, attached to handle panel 26 by fold line 28.

Side panel 18 is attached to end panel 30, which is attached to partition panel 31 by fold line 36. Partition panel 31 is composed of a keel 34, median panel 38 and end strip 40. Top flap 42 is foldably attached to top panel 22 by fold line 32 and in turn is attached to handle flap 44 by fold line 46. End panel 48 is attached to side panel 18 by fold line 50 and in turn attached to corresponding end panel 52 by fold line 54, 10 which in turn is foldably connected to side panel 56 by fold line 58. Side panel 56 is attached to bottom flap 60 by fold line 62 and foldably attached to top panel 64 by fold line 66 and in turn is attached to handle panel 68 by fold line 70. Side panel 56 is foldably attached to end panel 72 by fold line 74. End panel 72 is foldably attached to partition panel 75 by fold lines 78 and 82. Partition panel 75 Us composed of a keel 76, median panel 80 and end strip 81. Top panel 64 and handle panel 68 are foldably attached to top flap 84 and handle flaps 86, respectively, by fold line 74.

This carton is designed for being carried by handle apertures 90A–D in handle panels 26 and 68 and handle flaps 44 and 86. It is noted that two of these apertures 90B and 90C are provided with finger flaps 92A and 92B which are joined to the handle panels 26 and 68 by fold lines 94A–B. These are designed to provide a cushion for the fingers during the carrying of the carton loaded with heavy bottles. As this is a neck-through the top carton, neck apertures 96A–L are provided in top panels 22 and 64 and top flaps 42 and 84. The neck apertures 96A–L are round and accommodate the necks of bottles. A label saving opening is provided on these apertures by arcuate extended openings 98A–L projecting toward the adjacent handle panel or handle flap.

Fold line 100 may be provided in top panels 22 and 64 to facilitate the loading of the bottles and extension of the necks of the bottles through the apertures 96A–L.

Partition panels 31 and 75 are provided with cell dividers 102A–D, which are attached to the partition panels by fold lines 104A–D. Each of the cell dividers 102A–D is attached to the respective side panels 18 or 56 by glue tabs 106A–D which are attached by fold lines 108A–D to the respective cell divider 102A–D. Partition panel 75 is provided by glue tabs 110 for gluing to end panel 52.

Figure 2:
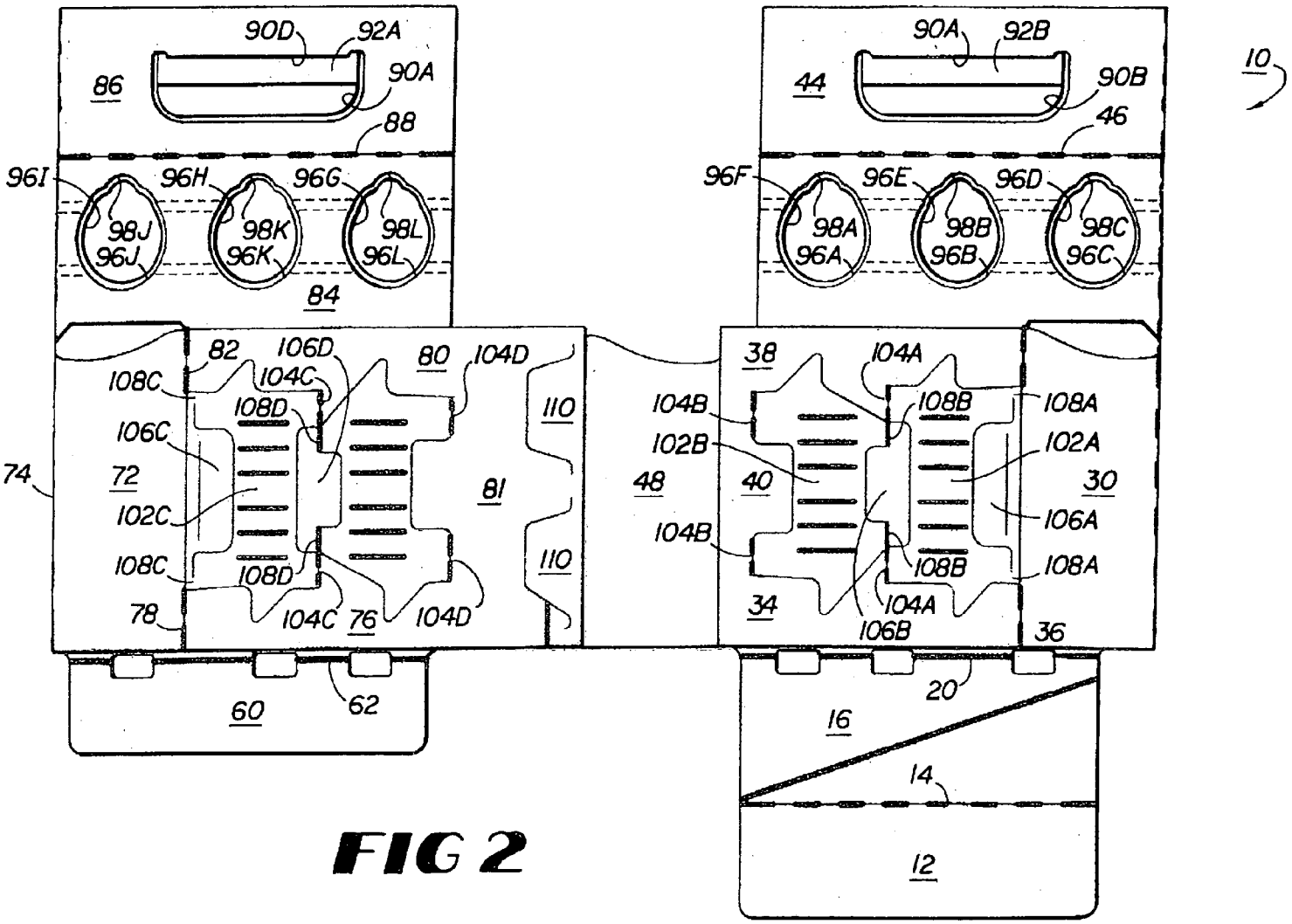
FIG. 2 is a plan view of the blank of FIG. 1 in which the partition panels are folded onto the side panels and the handle flaps have been folded onto the handle panels.

The carton of this invention is designed to be folded and glued on an in-line gluer. Consequently, all the fold lines that need to be folded in the process of constructing this carton are parallel to each o her. Thus, line 74 is parallel to lines 58, 54, 50 and 32. In the first step on the in-line gluer, end panel 30 and partition panel 31 and corresponding end panel 72 and partition panel 75 are folded onto side panels 18 and 56, respectively. Glue tabs 106A–D are folded and glued to their respective side walls 18 and 56. Glue tabs 110 are glued to end panel 52 adjacent to fold line 54. At the same time, top flap 42 and handle flap 44 are folded onto top panel 22 and handle panel 26. Handle flap 44 is glued to handle panel 26. Similarly, top flap 84 and handle flap 86 are folded onto top panel 64 and handle panel 68 with handle flap 86 being glued to handle panel 68. This step is illustrated in FIG. 2.

Figure 3:
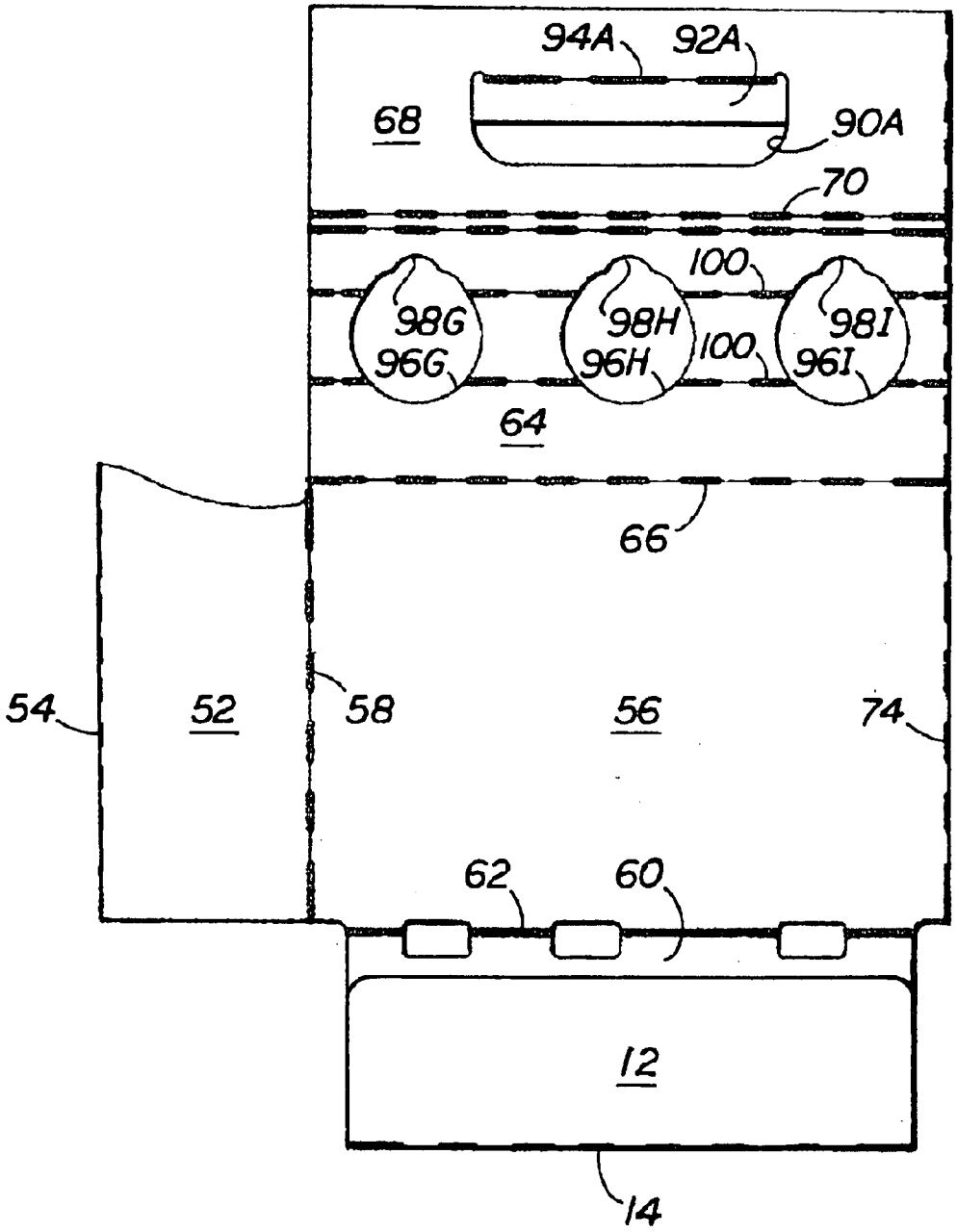
FIG. 3 is a plan view of the blank of FIG. 2 which has been folded further about a center line and glued together.

The next step is illustrated in FIG. 3. The two sides of the carton are folded one up on the other and glued. Handle flap 44 is folded onto handle flap 86 and glued to make a four-ply handle structure. While the four pay handle is preferred, it is possible to make an acceptable carton with a two ply or three ply handle, depending on the factors of paperboard strength and the weight of the product carried. As part of that process, top flap 42 is folded onto top of top flap 84 to form a two-ply panel. Partition panel 31 is folded onto the top of partition panel 75, with keel 34 being glued to keel 76, median panel 38 being glued to median panel 80. End strip 40 is glued to end strip 81. Note that while keel 34 is shown as somewhat smaller than keel 76, the two keel members may be the same size if desired. In this case, the finished carton will be somewhat more rigid.

Figure 4:
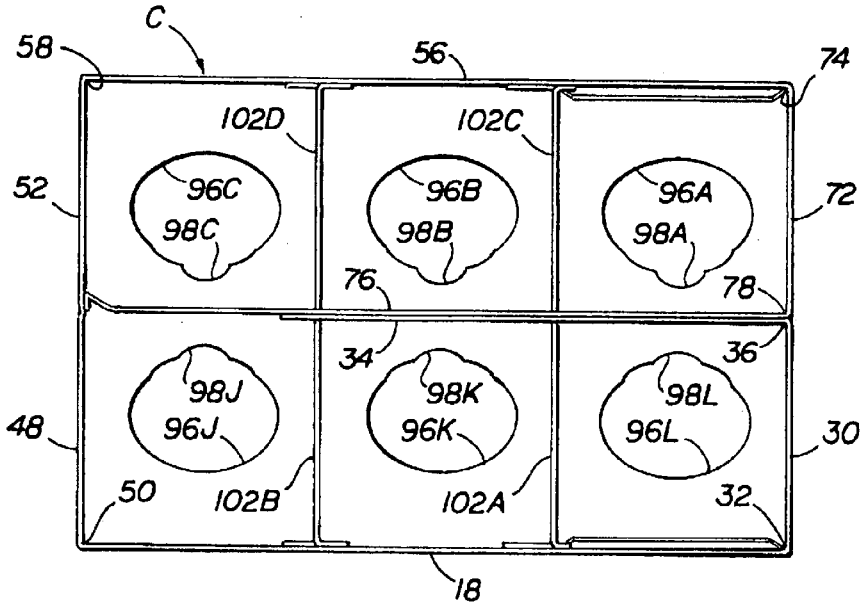
FIG. 4 is a bottom view of the carton of FIG. 3 that has been opened up to show the interior structure of the carton.
Figure 5:
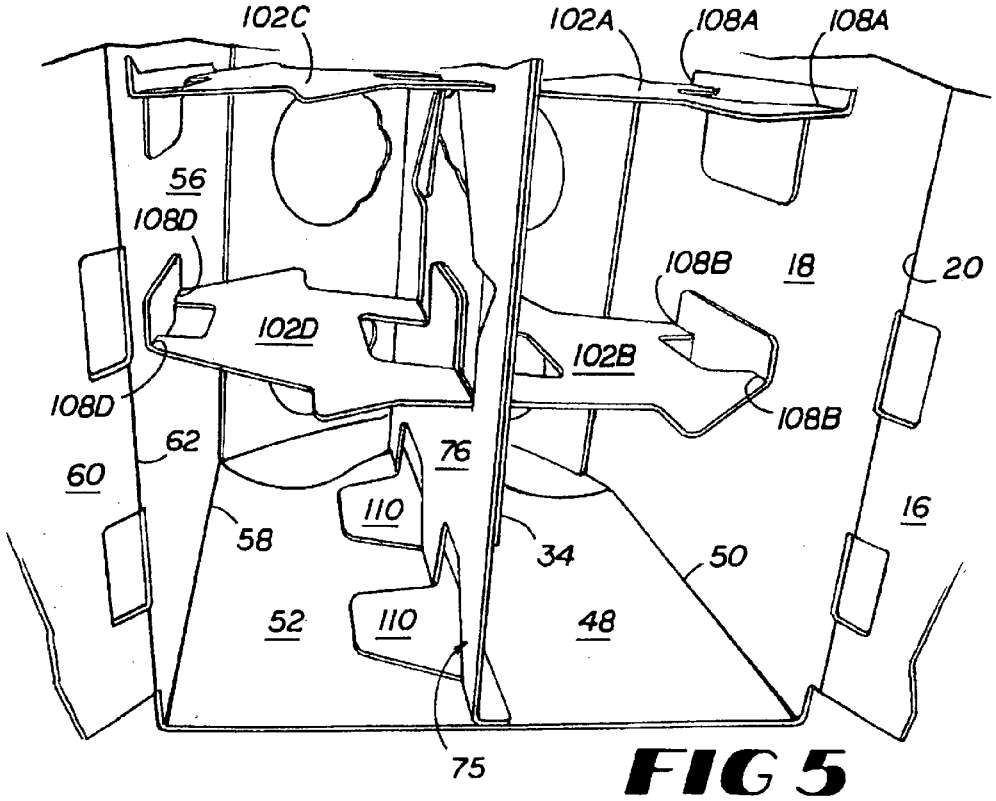
FIG. 5 is a perspective view of the carton of FIG. 3 that has been opened to show two-ply partition panel and cell dividers.
Figure 6:
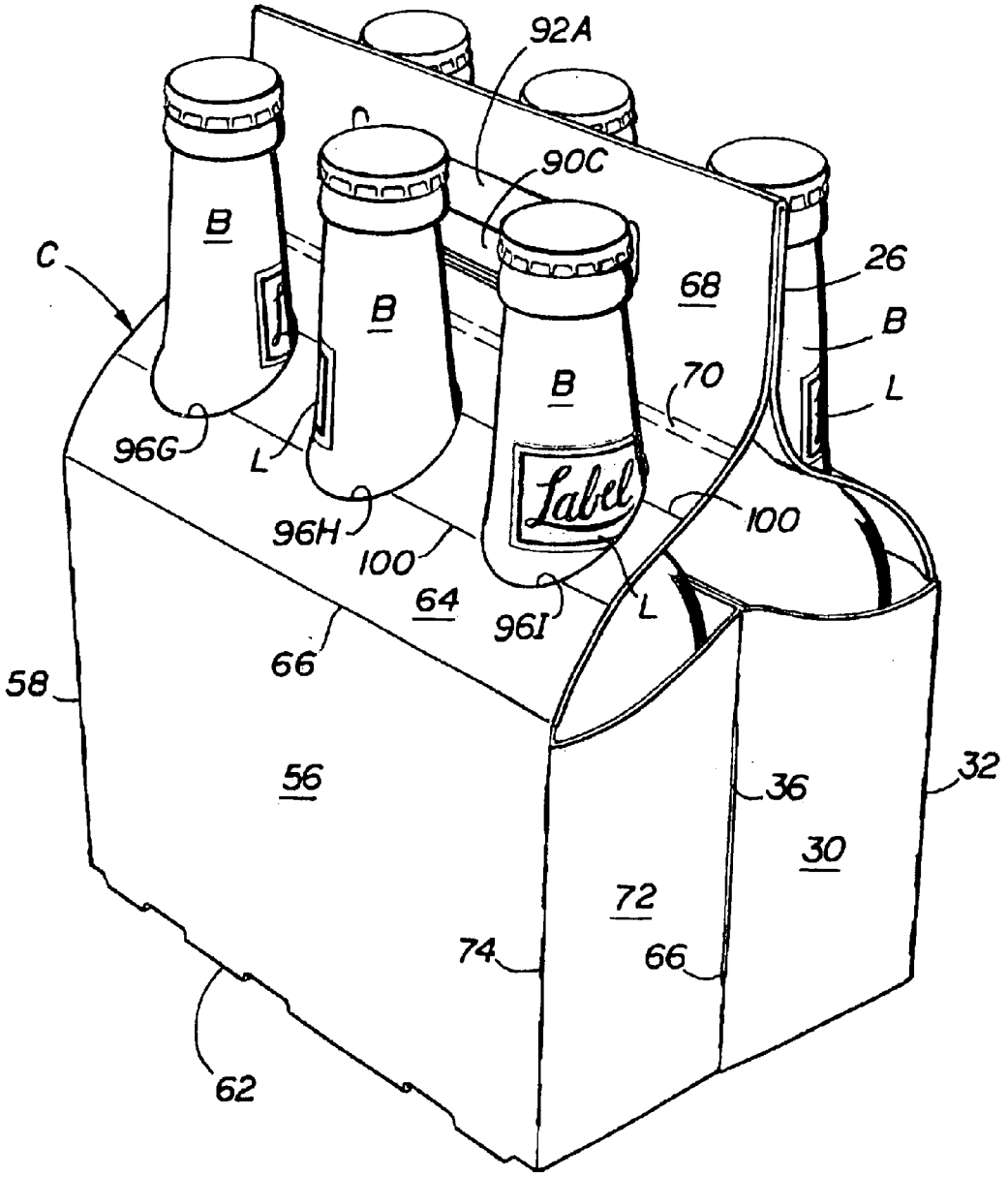
FIG. 6 is a perspective view of the carton of FIG. 3 that has been filled with bottles and the bottom glued together.
Figure 7:
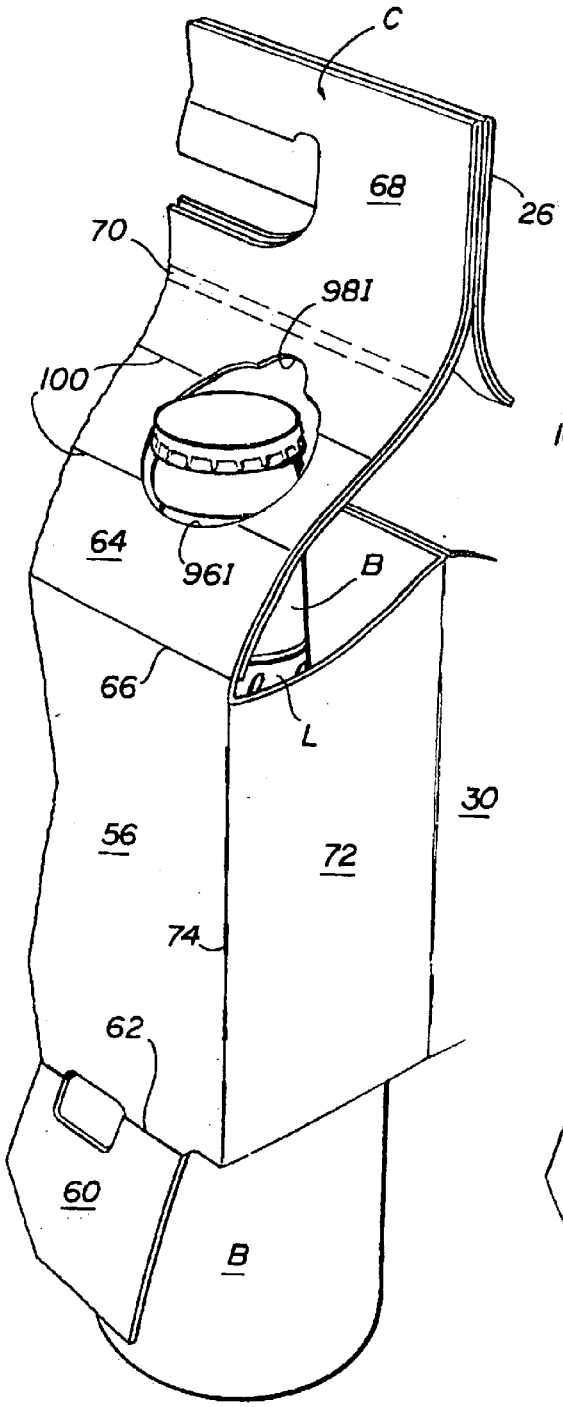
FIG. 7 is a perspective view of the carton of FIG. 4 which is being loaded with bottles to show the apertures through which the necks of the bottles extend.
Figure 8:
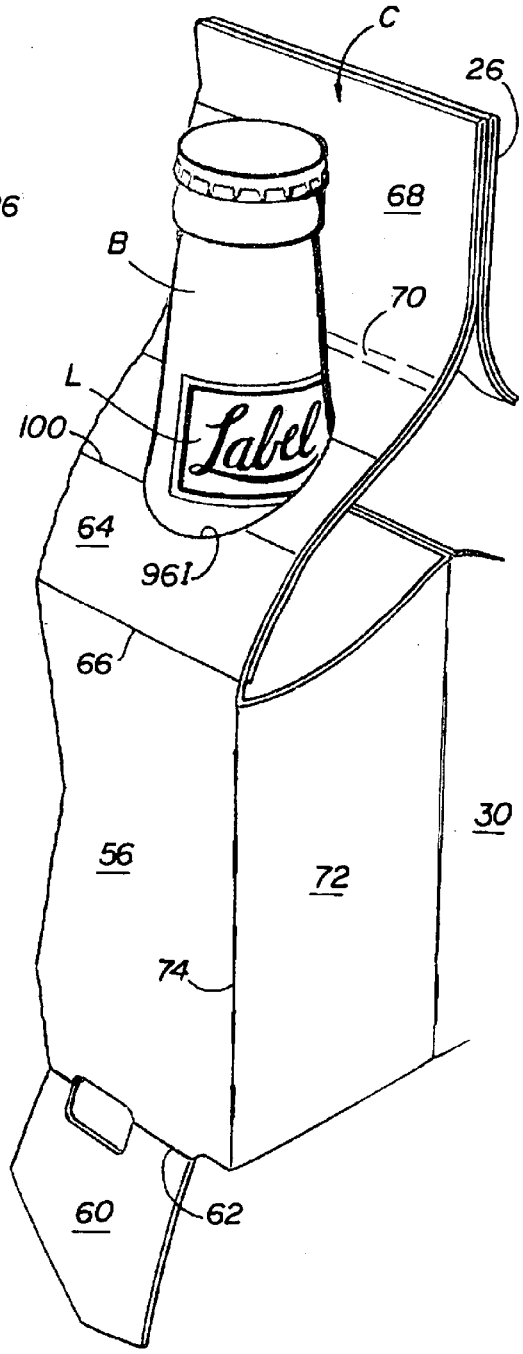
FIG. 8 is a perspective view of the bottles extending through apertures in a fully loaded carton.

The interior structure of the carton of this embodiment is illustrated in FIG. 4, and shows the two-ply median panel cell dividers. FIG. 5 is a top view of the interior of the carton showing the median panel, the two-ply partition panel and cell dividers, with glue tabs attached to the end wall. At this point, the carton is ready to be shipped to a bottling plant to be loaded with bottles. A carton of this embodiment that is loaded with bottles B is illustrated in FIG. 6. FIG. 7 illustrates the bottle necks partially inserted through the neck apertures and also illustrates the arcuate extended openings 98A–B. FIG. 8 shows the necks of the bottles that have been fully inserted into the neck apertures with the label L being visible. The bottles have been inserted through the neck aperture so that flap 60 can be glued to bottom flap 12 to finish the process.

While the invention has been disclosed in its preferred forms, it will be apparent to those skilled in the art that many modifications, additions, and deletions can be made therein without departing from the spirit and scope of the invention and its equivalents as set forth in the following claims.

UNIQUE FEATURES OF THIS INVENTION

The carton of this invention has several unique features. In first place all of the fold lines for forming this carton are parallel to each other. This carton provides full protection for the bottles in that it has a two-ply top panel with neck apertures and a four-ply handle and a two-ply partition panel between the rows of bottles.

The arcuate extended opening projects toward the handle minimizing damage to labels on the necks of bottles.

What is claimed:

1. A neck-through the top blank which may be folded and glued on an in-line gluer into a folded carton with fold lines ready for opening and loading with bottles, said carton having bottom, side and end walls, with one end wall divided into two parts with a partition panel foldable attached to each part, with each partition panel having a plurality of cell dividers, a top panel attached to each side wall, and a handle panel attached to each top panel, each top panel and handle panel being foldably attached respectively to a corresponding top flap and handle flap, so that when all the top and handle panels and flaps are folded upon each other, a pair of two-ply top panels and a four-ply handle panel are formed, said top panels and flaps having corresponding apertures for the necks of bottles.

2. The blank of claim 1 in which each partition panel has a top and bottom and two ends, with a median panel extending across the top and a keel extending across the bottom and an end strip extending across one end, said median panel and keel panel being disposed so that when the carton is folded the median panel and keel on each partition panel can respectively be glued together to form a two-ply median panel and two-ply keel.

3. The blank of claim 2 in which the end strips on each partition panel are disposed so that they can be glued together to form a two-ply end strip when the carton is folded.

4. The blank of claim 3 in which the apertures in the top panels and top flaps are round in shape with an arcuate extended opening in each aperture projecting towards the handle panel and handle flaps respectively.

5. The blank of claim 2 in which the apertures in the top panels and top flaps are round in shape with an arcuate extended opening in each aperture projecting towards the handle panel and handle flaps respectively.

6. The blank of claim 1 in which the apertures in the top panels and top flaps are round in shape with an arcuate extended opening in each aperture projecting towards the handle panel and handle flaps respectively.

7. The blank of claim 1 in which all of the fold lines that are folded in gluing the blank into a carton are parallel to each other.

8. A neck-through the top carton for carrying bottles with necks, said carton having bottom, side and end walls, with one end wall divided into two parts with a partition panel attached to each part, said partition panels being glued to each other with each partition panel having a plurality of cell dividers, each with a tab glued to an adjacent side wall, with a top panel attached to each side wall with each top panel attached to a top flap in an overlapping position and a handle panel attached to each top panel and top flap, with a handle flap attached to each handle panel, with all handle panels and flaps being glued together in an overlapping position to form a four-ply handle, said top panels and top flaps having apertures for receiving the necks of bottles.

9. The carton of claim 8 in which each partition panel has a top and bottom and two ends, with a median panel extending across the top and a keel extending across the bottom, said median panels and keels of each partition panel being glued together respectively in an overlapping position to hold the respective median panels and keels together.

10. The carton of claim 9 in which each partition panel also has an end strip with the end strips of the partition panels being glued together.

11. The carton of claim 9 in which the apertures in the top panels and top flaps are round in shape with an arcuate extended opening in each aperture projecting towards the handle panel and handle flap respectively.

12. The carton of claim 10 in which the apertures in the top panels and top flaps are round in shape with an arcuate extended opening in each aperture projecting towards the handle panel and handle flap respectively.

13. The carton of claim 8 in which the apertures in the top panels and top flaps are round in shape with an arcuate extended opening in each aperture projecting towards the handle panel and handle flap respectively.

* * * * *